US005220713A

United States Patent [19]

Lane, Jr. et al.

[11] Patent Number: 5,220,713

[45] Date of Patent: Jun. 22, 1993

[54] APPARATUS FOR USE WITH A SAFETY BELT

[75] Inventors: Wendell C. Lane, Jr., Romeo; Kevin M. Gillis, Sterling Hts.; Bob L. McFalls, Shelby Township, all of Mich.

[73] Assignee: TRW Vehicle Safety Systems Inc., Lyndhurst, Ohio

[21] Appl. No.: 937,538

[22] Filed: Aug. 28, 1992

[51] Int. Cl.[5] ..... A44B 11/26

[52] U.S. Cl. ..... 24/628; 24/633

[58] Field of Search ..... 24/628, 633; 297/468; 116/281, 283

[56] References Cited

U.S. PATENT DOCUMENTS 3,768,862 10/1973 Williams, Jr. .
3,897,611 8/1975 Booth et al. .
5,023,981 6/1991 Anthony et al. .
5,149,189 9/1992 Kawamura ..... 24/633 X

FOREIGN PATENT DOCUMENTS 141734 5/1985 European Pat. Off. ..... 24/633
3302723 8/1984 Fed. Rep. of Germany ..... 24/633

*Primary Examiner*—James R. Brittain
*Attorney, Agent, or Firm*—Tarolli, Sundheim & Covell

[57] ABSTRACT

An improved apparatus for interconnecting safety belts includes a buckle member which receives a tongue member to interconnect the safety belts. An indicator and ejector assembly has a visually readable indicia which changes from red to green as the tongue and buckle members are interconnected. As the tongue and buckle members are disconnected, the indicia changes from green back to red. The indicia is disposed on an indicator member which transmits force to eject the tongue member at least partially from the buckle member as the tongue and buckle members are disconnected.

26 Claims, 3 Drawing Sheets

APPARATUS FOR USE WITH A SAFETY BELT

FIELD OF THE INVENTION

The present invention relates to a safety apparatus, and particularly to a tongue and buckle used with safety belts.

BACKGROUND OF THE INVENTION

Safety seats for children are commonly provided in vehicles. A typical safety seat for a child has a crotch belt to which is attached a buckle that receives either a single tongue or a pair of tongues connected with a pair of shoulder belts. In order to retain the child securely in the seat, it is important that the tongue or tongues be fully inserted into the buckle.

SUMMARY OF THE INVENTION

In accordance with a preferred embodiment of the invention, a vehicle safety apparatus includes a buckle member which receives a tongue member to interconnect safety belts. An indicator is provided to indicate when the tongue and buckle members have been interconnected. Thus, as the buckle and tongue members are interconnected, a visually readable indicia associated with the indicator changes from a first color to a second color.

The indicator includes an indicator member. As the buckle and tongue member are interconnected, the indicator member is moved from an extended position to a retracted position relative to a housing. This movement of the indicator member changes indicia exposed to view at an opening in the housing from the first color to the second color. As the tongue and buckle members are disconnected, a spring urges the indicator member back to the extended position and causes the indicator member to eject the tongue member at least partially from the buckle member. As this occurs, the indicia exposed to view at the opening in the housing is changed from the second color back to the first color.

BRIEF DESCRIPTION OF THE DRAWINGS

These and other features of the present invention will become more apparent to those skilled in the art upon reading the following description of a preferred embodiment in view of the accompanying drawings, wherein.

DESCRIPTION OF PREFERRED EMBODIMENTS

Figure 1:
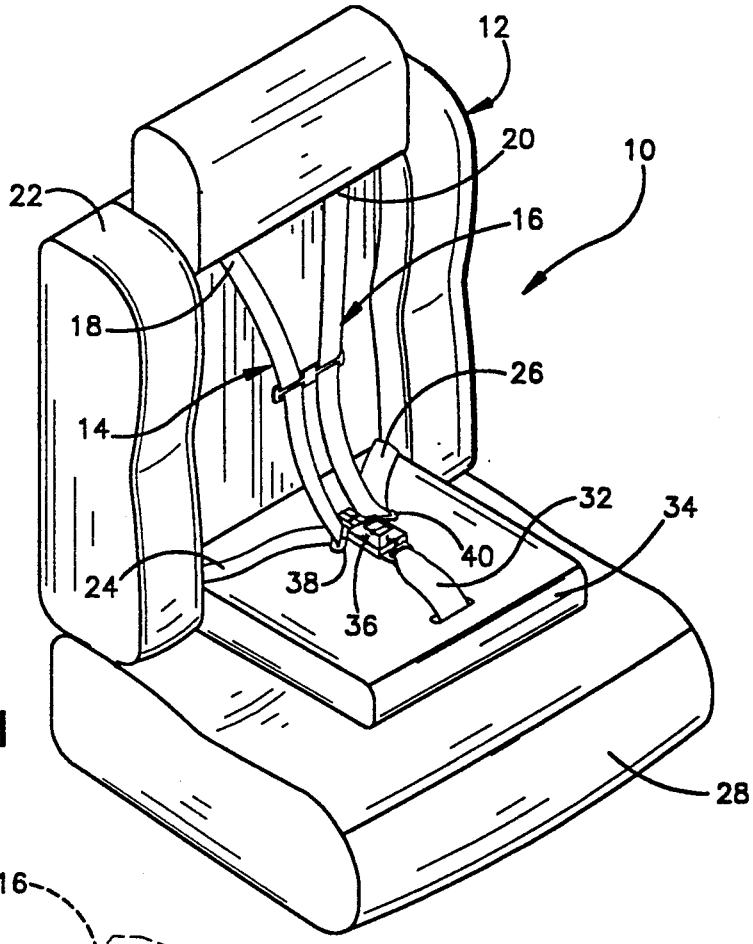
FIG. 1 is a pictorial illustration depicting the relationship of a child restraint system to a vehicle seat.

A child restraint system 10 is illustrated in FIG. 1 in association with a vehicle seat 12. The child restraint system 10 includes a pair of shoulder belts 14 and 16. The shoulder belts 14 and 16 have upper end portions 18 and 20, respectively, which are secured to a back 22 of the seat 12. Lower end portions 24 and 26 of the shoulder belts 14 and 16, respectively, are secured to the vehicle seat 12 where the seat back 22 and a main seat cushion 28 come together.

Figure 2:
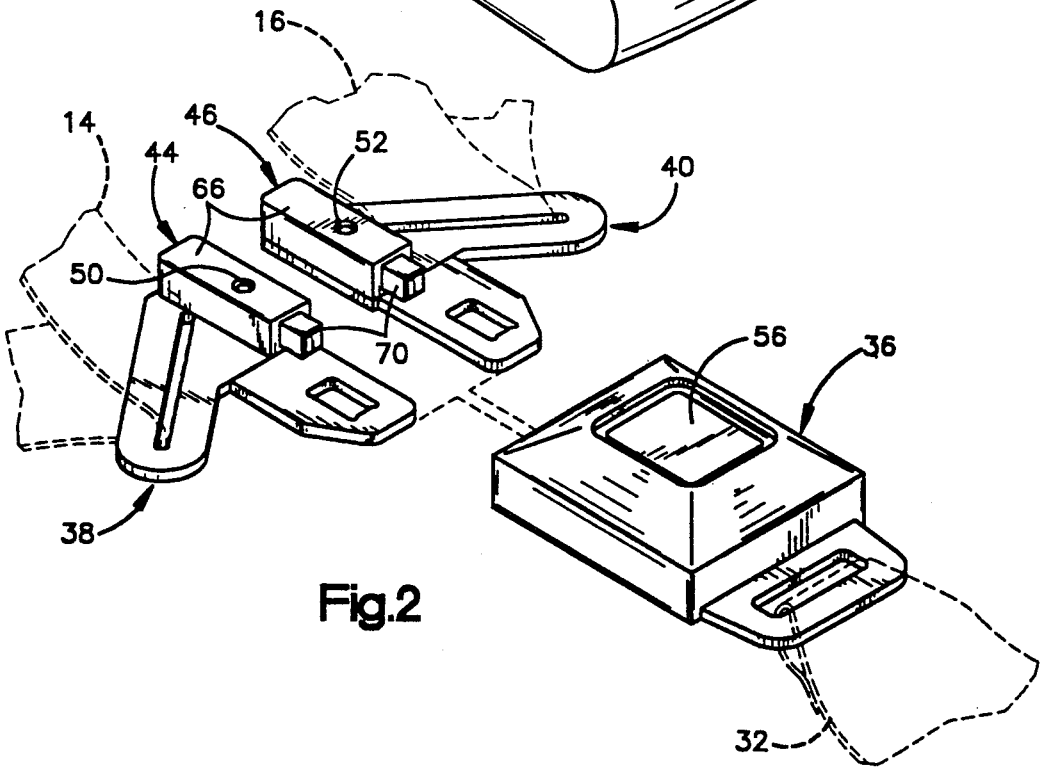
FIG. 2 is a schematicized illustration depicting the manner in which a pair of tongue members are inserted into a buckle member to interconnect the tongue and buckle members.
Figure 3:
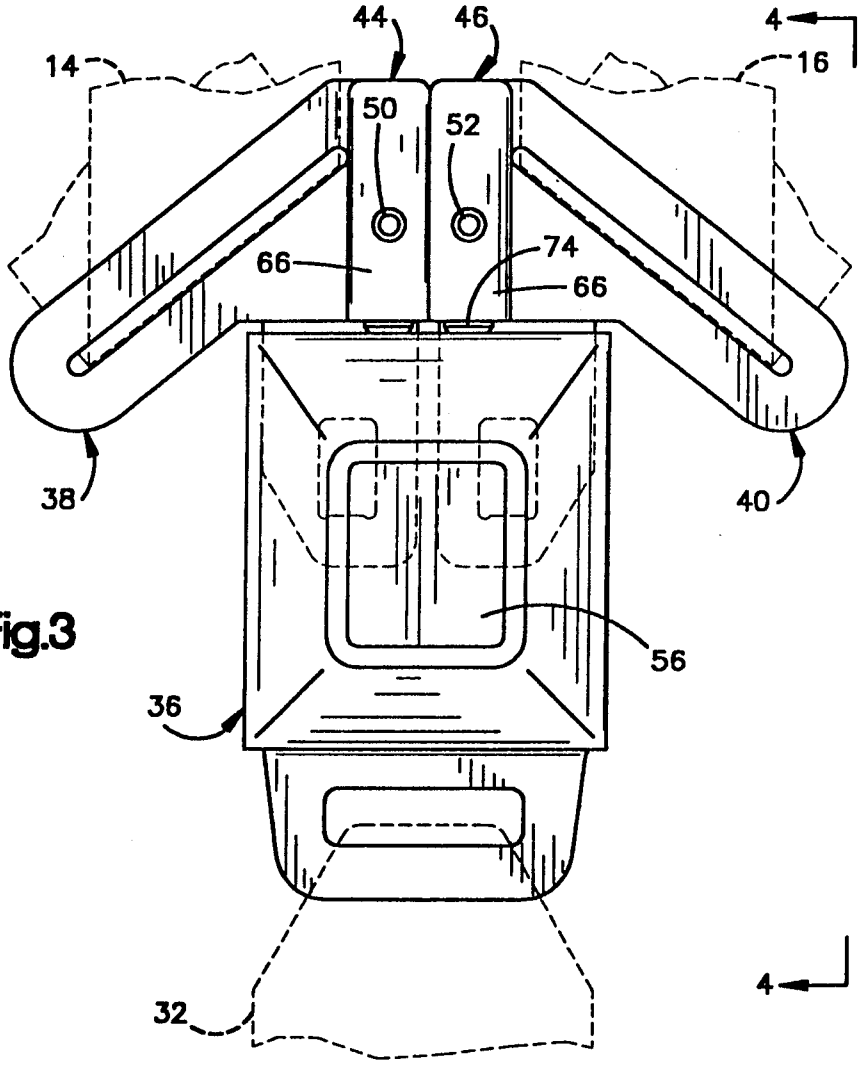
FIG. 3 is an enlarged and somewhat schematicized illustration showing the tongue members and buckle member interconnected.

A crotch belt 32 extends upwardly from a child seat cushion 34. A buckle member 36 is connected to an upper end portion of the crotch belt 32. The buckle member 36 receives a pair of tongue members 38 and 40 (FIGS. 1–3) to interconnect the shoulder belts 14 and 16 and crotch belt 32 in a well known manner. If desired, the shoulder belts 14 and 16 could be connected with a single tongue member rather than a pair of tongue members.

When a child is to be secured by the restraint system 10, the shoulder belts 14 and 16 are positioned around the shoulders of the child. The crotch belt 32 extends upwardly between the child's legs. The tongue members 38 and 40 are then inserted into the buckle member 36 to interconnect the shoulder belts 14 and 16 and crotch belt 32. The buckle member 36 includes a suitable latch mechanism (not shown) to latch the tongue members 38 and 40 in the buckle member 36. Although the child restraint system 10 has been illustrated in FIG. 1 as being permanently installed in association with a vehicle seat 12, the child restraint system could be used in association with a child seat which is separate from the vehicle sea and is portable.

Figure 4:
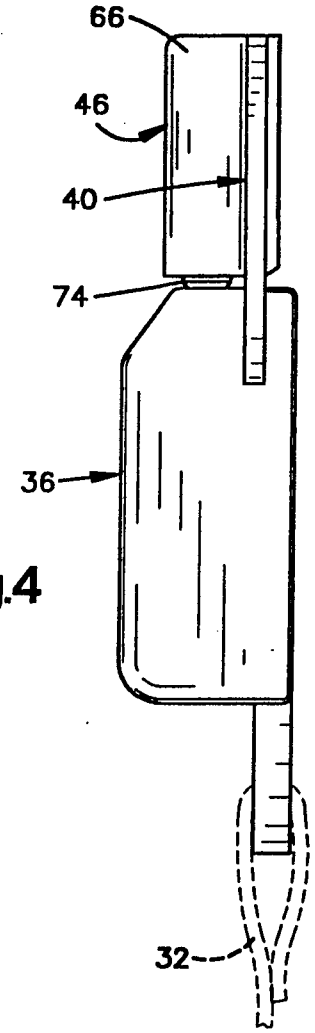
FIG. 4 is a side elevational view, taken generally along the line 4—4 of FIG. 3.

In accordance with a feature of the invention, indicator and ejector assemblies 44 and 46 (FIGS. 2–4) on the tongue members 38 and 40 change visibly readable indicia at display openings 50 and 52 (FIGS. 2 and 3) as the tongue members are fully inserted into and are engaged by the latch mechanism (not shown) in the buckle member 36. The visually readable indicia at the openings 50 and 52 change from red to green to provide a clear and easily readable indication that the tongue members 38 and 40 are securely connected with the buckle member 36. If one of the tongue members 38 or 40 should not be fully inserted into the buckle member 36, the indicia which is visible at the opening 50 or 52 will either remain red or only partially change from red to green.

In accordance with another feature of the invention, as the tongue members 38 and 40 ar disconnected from the buckle member 36, the indicator and ejector assemblies 44 and 46 at least partially eject the tongue members 38 and 40 from the buckle member 36. Specifically, when the tongue members 38 and 40 are to be disconnected from the buckle member 36, a pushbutton 56 (FIG. 3) on the buckle member 36 is depressed. This causes the latch mechanism in the buckle member 36 to disengage from the tongue members 38 and 40. The indicator and ejector assemblies 44 and 46 then move the tongue members 38 and 40 upwardly (as viewed in FIG. 3) to disengage the tongue members at least partially from the buckle member 36. As the tongue members 38 and 40 are disengaged from the buckle member 36, the indicia visible at the openings 50 and 52 change from green back to red.

The indicator and ejector assembly 46 is mounted on a metal base 60 (FIG. 5) of the tongue member 40. The metal base 60 is generally V-shaped with an opening 94 formed at the end of one leg of the V. The opening 94 is engaged b the latch mechanism of the buckle member 36. A slot 62 extends along the length of the other leg of the V-shaped base 60 and receives the shoulder belt 16. The indicator and ejector assembly 46 is disposed adjacent to the slot 62 and extends toward the opening 94.

Figure 6:
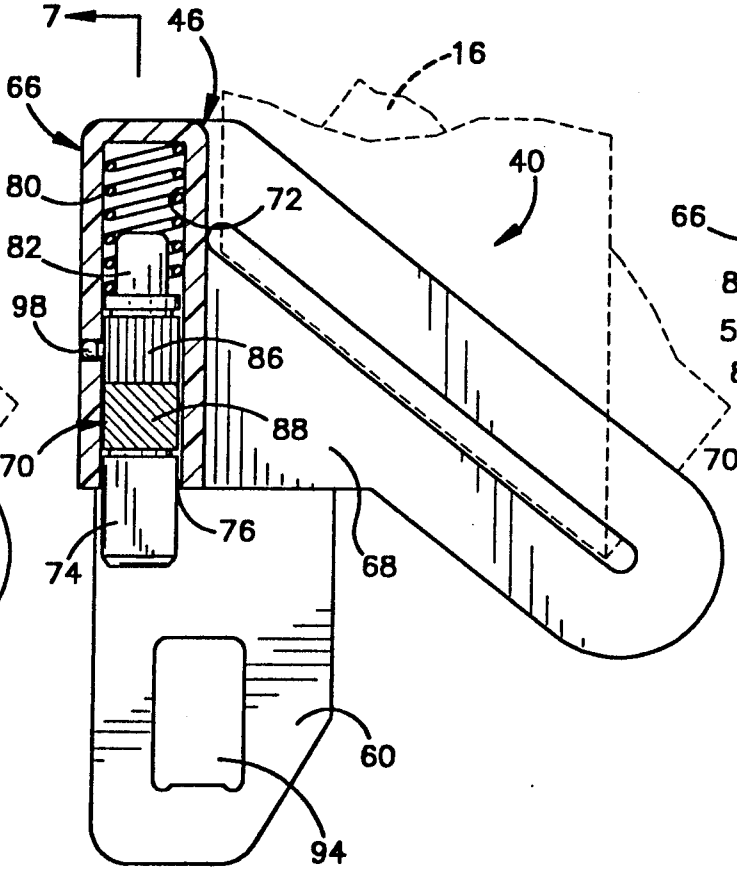
FIG. 6 is an enlarged and partially broken away view of the tongue member of FIG. 5.
Figure 5:
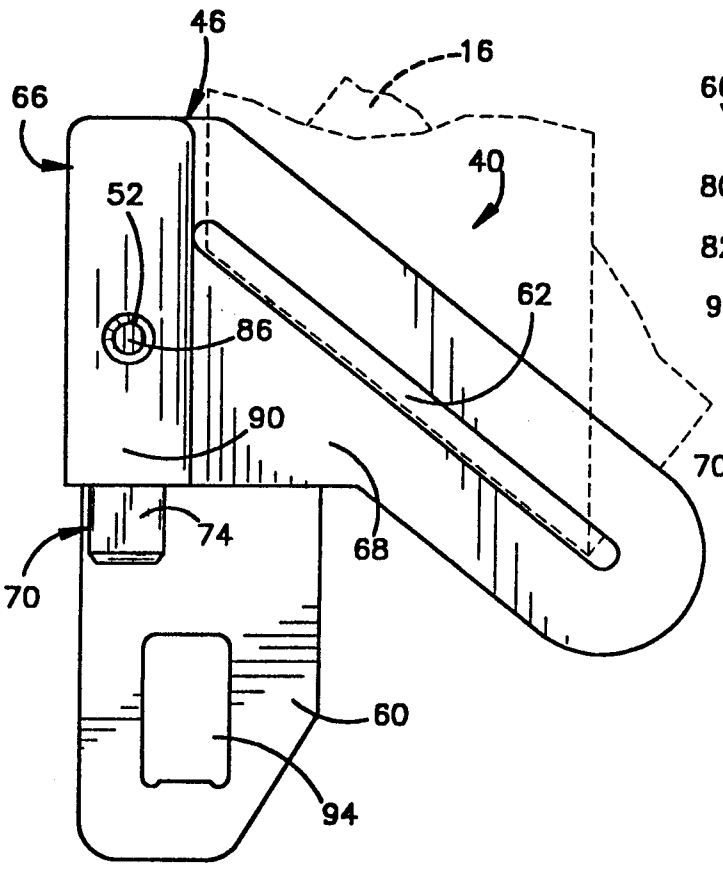
FIG. 5 is an enlarged plan view of one of the tongue members.

The indicator and ejector assembly 46 includes a generally rectangular housing 66 (FIGS. 5 and 6). The housing 66 and an associated cover layer 68 are molded as one piece of plastic. The cover layer 68 encloses a portion of the metal base 60 of the tongue member 40 which defines the opening 62. A rectangular indicator member 70 is slidably disposed in a generally rectangular chamber 72 formed in the housing 66.

An outer end portion 74 of the indicator member 70 has a rectangular cross sectional configuration and projects through a rectangular opening 76 formed in the housing 66. A coil spring 80 (FIGS. 6 and 7) telescopes over a cylindrical inner end portion 82 of the indicator member 70. The coil spring 80 urges the indicator member 70 to the extended position of FIGS. 6 and 7.

When the indicator member 70 is in the extended position, a red indicia 86 on the indicator member 70 (FIGS. 6 and 7) is visible through the display opening 52 (FIG. 7) in the housing 66. At this time, a green indicia 88 on the indicator member 70 is covered by a wall 90 of the housing 66. If desired, the indicia 86 and 88 could be mounted on a member which is separate from and movable by the indicator member 70.

Figure 7:
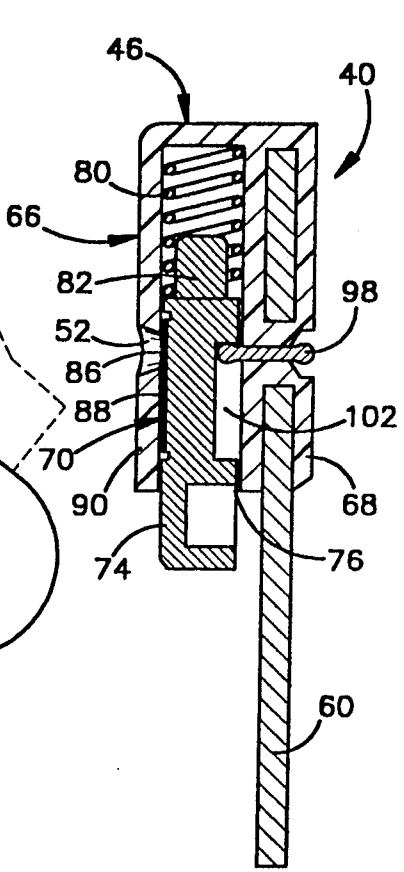
FIG. 7 is a sectional view, taken generally along the line 7—7 of FIG. 6.

As the tongue member 40 is inserted into the buckle member 36 (FIG. 3), the outer end portion 74 (FIG. 6) of the indicator member 70 engages the buckle member. Continued insertion of the tongue member 40 into the buckle member 36 moves the indicator member 70 into the housing 66 against the influence of the coil spring 80. When the latch mechanism in the buckle member 36 engages the opening 94 (FIG. 6) formed in the base 60 of the tongue member 40, the green indicia 88 will have moved into alignment with the opening 52 (FIG. 7).

A retainer member 98 connected to the housing 66 extends through the base 60 of the tongue member 40 into a rectangular recess 102 formed in the indicator member 70. The engagement between the retainer member 98 and the recess 102 limits the extent of inward and outward movement of the indicator member relative to the housing 46.

When the buckle member 36 is actuated to release the tongue member 40 by pressing the button 56 (FIG. 3), the indicator and ejector assembly 46 is effective to disengage the tongue member 40 at least partially from the buckle member. Thus, when the latch mechanism in the buckle member 36 is disengaged from the tongue member 40, the force applied against the indicator member 70 (FIG. 6) by the coil spring 80 causes the indicator member to move from a retracted position back toward its extended position. As this occurs, the outer end portion 74 of the indicator member 70 presses against the buckle member 36. The force applied by the indicator member 70 against the buckle member 36 moves the tongue member 40 outwardly away from the buckle member.

Although the foregoing description has been of the indicator and ejector assembly 46 on the tongue member 40, it should be understood that the indicator and ejector assembly 44 on the tongue member 38 has the same construction as the indicator and ejector assembly 46. It should also be understood that although the indicator and ejector assemblies 44 and 46 have been disclosed as being mounted on the tongue members 38 and 40, the indicator and ejector assemblies could be mounted on the buckle member 36 if desired.

In the illustrated embodiment of the invention, the indicia 86 is a uniform area of the color red, and the indicia 88 is a uniform area of the color green. If desired, colored or plain letters could be substituted for the red and green indicia 86 and 88. Also, although the invention has been disclosed as being used in a child restraint system 10, the invention could be used in other restraint systems having a safety belt.

From the above description of the invention, those skilled in the art will perceive improvements, changes and modifications. Such improvements, changes and modifications within the skill of the art are intended to be covered by the appended claims.

We claim:

1. An apparatus for use with a safety belt, said apparatus comprising:

a tongue member;

a buckle member for receiving said tongue member to interconnect said buckle member and tongue member; and indicator means on at least one of said members for indicating when said buckle member and tongue member have been interconnected by changing a visually readable indicia from a first color to a second color, said indicator means includes means for forming an opening on one of said members, a surface area of the first color, and a surface area of the second color, said surface area of a first color being viewable through said opening when said tongue member is less than fully inserted into said buckle member, only said surface area of a second color being viewable through said opening when said tongue member is fully inserted into said buckle member.

2. An apparatus as set forth in claim 1 wherein said surface area of a first color and said surface area of a second color are moved relative to said opening as said tongue member is inserted into said buckle member.

3. An apparatus as set forth in claim 1 wherein said surface area of a first color and said surface area of a second color are mounted on said tongue member.

4. An apparatus as set forth in claim 1 wherein said indicator means includes an indicator element which is movable relative to one of said buckle and tongue members during insertion of said tongue member into said buckle member, said area of a first color and said area of a second color being disposed on said indicator element.

5. An apparatus as set forth in claim 4 wherein said indicator element is connected with said tongue member.

6. An apparatus as set forth in claim 4 further including means for mounting said indicator element on said tongue member and for enabling said indicator element to move relative to said tongue member during insertion of said tongue member into said buckle member.

7. An apparatus as set forth in claim 6 wherein said means for mounting said indicator element on said tongue member includes means for at least partially defining said opening.

8. An apparatus for use with a safety belt, said apparatus comprising:

a tongue member;

a buckle member for receiving said tongue member to interconnect said buckle member and tongue member; and indicator means on at least one of said members for indicating when said buckle member and tongue member have been interconnected by changing a visually readable indicia from a first color to a second color, said indicator means includes means for forming an opening on a first one of said members, and an indicator member having a surface area of a first color and a surface area of a second color, said indicator member being movable relative to said first one of said members from a first position in which said surface area of a first color is visible through said opening to a second position in which said surface area of a second color is visible through said opening as said tongue member is inserted into said buckle member.

9. An apparatus as set forth in claim 8 further including spring means for moving said indicator member from said second position to said first position as said tongue member is withdrawn from said buckle member.

10. An apparatus as set forth in claim 9 wherein said spring means presses said indicator member against said buckle member with a force which at least partially ejects said tongue member from said buckle member when said buckle member is operated from an engaged condition to a release condition.

11. An apparatus as set forth in claim 8 wherein said indicator member is connected with said first one of said members.

12. An apparatus as set forth in claim 8 wherein said indicator member has an elongated configuration with a longitudinal axis extending generally parallel to a direction of insertion of said tongue member into said buckle member.

13. An apparatus for use with a safety belt, said apparatus comprising:

a tongue member;

a buckle member for receiving said tongue member to interconnect said buckle member and tongue member; and indicator means on at least one of said members for indicating when said buckle member and tongue member have been interconnected by changing a visually readable indicia from a first color to a second color, said indicator means including a housing disposed on said tongue member, said housing having a first opening at one end and a second opening formed in a side wall of said housing, an indicator member disposed in said housing, said indicator member having a first portion which extends through said first opening and is engageable by said buckle member as said tongue and buckle members are interconnected to move said indicator member relative to said housing from an extended condition to a retracted condition, said indicator member having a second portion upon which said first and second colors are disposed, said first color on said indicator member being visible through the second opening when said indicator member is in the extended condition and said second color on said indicator member being visible through said second opening when said indicator member is in the retracted condition.

14. An apparatus for use with a safety belt, said apparatus comprising:

a tongue member;

a buckle member for receiving said tongue member to interconnect said buckle member and tongue member; and indicator means for indicating when said buckle and tongue members have been interconnected by changing a visually readable indicia from a first condition to a second condition, said indicator means including an indicator member which is disposed on said tongue member and is movable relative to said tongue member from a first position to a second position to change said visually readable indicia from the first condition to the second condition as said buckle and tongue members are interconnected.

15. An apparatus as set forth in claim 14 wherein said indicator member is engageable by said buckle member to move said indicator member from the first position to the second position under the influence of force transmitted from said buckle member to said indicator member as said buckle and tongue members are interconnected.

16. An apparatus as set forth in claim 14 further including spring means for moving said indicator member from the second position to the first position to change said visually readable indicia from the second condition to the first condition as said buckle and tongue members are disconnected.

17. An apparatus as set forth in claim 14 further including spring means for pressing said indicator member against said buckle member to eject said tongue member at least partially from said buckle member as said buckle and tongue members are disconnected and for moving said indicator member from the second position to the first position to change said visually readable indicia from the second condition to the first condition as said buckle and tongue members are disconnected.

18. An apparatus as set forth in claim 14 wherein said indicator means includes a housing disposed on said tongue member, said housing having an opening through which said visually readable indicia is visible, said indicator member being at least partially disposed in said housing and being movable relative to said housing from the first position to the second position to change said visually readable indicia from the first condition to the second condition as said buckle and tongue members are interconnected.

19. An apparatus as set forth in claim 14 wherein said indicator means includes indicia of a first color which only is visually readable when said indicator member is in the first position and indicia of a second color which only is visually readable when said indicator member is in the second position.

20. An apparatus for use with a safety belt, said apparatus comprising:

a tongue member;

a buckle member for receiving said tongue member to interconnect said buckle member and tongue member; and indicator means on at least one of said buckle and tongue members for indicating when said buckle member and tongue member have been interconnected, said indicator means including an indicator member which is disposed on and is movable relative to said one of said buckle and tongue members from a first position in which first indicia is exposed to view and second indicia is covered to a second position in which the first indicia is covered and the second indicia is exposed to view as said buckle and tongue members are interconnected.

21. An apparatus as set forth in claim 20 wherein said indicator means includes means disposed on-said one of said buckle and tongue members for forming an opening, said first indicia being visible through the opening when said indicator member is in the first position and said tongue and buckle members are disconnected, said second indicia being visible through the opening when said indicator member is in the second position and said tongue and buckle members are disconnected.

22. An apparatus as set forth in claim 21 wherein said first indicia is disposed on a first portion of said indicator member and said second indicia is disposed on a second portion of said indicator member, said first portion of said indicator member being visible through the opening when said indicator member is in the first position, said second portion of said indicator member being visible through the opening when said indicator member is in the second position.

23. An apparatus as set forth in claim 21 wherein said means for forming an opening includes inner and outer side surface areas, said indicator member being slidable along said inner side surface area as said tongue member is inserted into said buckle member.

24. An apparatus as set forth in claim 20 wherein said indicator means is disposed on said tongue member.

25. An apparatus as set forth in claim 20 wherein said indicator means includes means for transmitting force between said buckle member and said tongue member to at least partially eject said tongue member from said buckle member as said tongue and buckle members are disconnected.

26. An apparatus as set forth in claim 20 wherein said first indicia is of a first color and said second indicia is of a second color.

* * * * *